US006149145A

United States Patent [19]

Lin

[11] Patent Number: 6,149,145

[45] Date of Patent: Nov. 21, 2000

[54] WORKBENCH HAVING A QUICK RELEASE PLATFORM

[76] Inventor: Huang Lung Lin, No. 33-2, Pu Gang Road, Pu Yien Hsiang, Chang Hua Hsien, Taiwan

[21] Appl. No.: 09/097,459

[22] Filed: Jun. 15, 1998

[51] Int. Cl.[7] ..... B25B 1/02

[52] U.S. Cl. ..... 269/139; 269/900; 269/901; 269/212

[58] Field of Search ..... 269/139, 212, 269/244, 208, 900, 901, 136, 215, 211

[56] References Cited

U.S. PATENT DOCUMENTS

| | | | |
|---|---|---|---|
| 4,052,046 | 10/1977 | Mortoly | 269/208 |
| 4,278,243 | 7/1981 | Alessio | 269/901 |
| 4,909,491 | 3/1990 | Cheng | 269/901 |
| 5,065,989 | 11/1991 | Ho | 269/901 |
| 5,338,016 | 8/1994 | Howard | 269/208 |
| 5,383,977 | 1/1995 | Pearce | 269/901 |
| 5,924,684 | 7/1999 | Cheng | 269/901 |

*Primary Examiner*—James G. Smith
*Assistant Examiner*—Lee Wilson
*Attorney, Agent, or Firm*—Dougherty & Troxell

[57] ABSTRACT

A workbench includes a base, a pair of beams disposed on top of the base and each having a number of holes, and two frames slidably engaged on the beams. A fixed platform is secured on the beams, and a slidable platform is secured on the frames for allowing the slidable platform to be moved along the beams. A positioning device is secured on the frame for engaging with the holes of the beams and for securing the frame and the slidable platform to the beams. The slidable platform may be easily and quickly moved along the beams when the positioning device is released.

18 Claims, 5 Drawing Sheets

WORKBENCH HAVING A QUICK RELEASE PLATFORM

BACKGROUND OF THE INVENTION

1. Field of the Invention

The present invention relates to a workbench, and more particularly to a workbench having a platform that may be quickly released and quickly positioned.

2. Description of the Prior Art

U.S. Pat. No. 4,909,491 to Cheng shows a typical workbench which includes a fixed platform solidly secured on top of a base and a slidable platform slidably supported on the base and movable toward and away from the fixed platform. Two bolts are rotatably secured in the base and coupled to the slidable platform for moving the slidable platform toward and away from the fixed platform. However, the slidable platform may only be moved slowly by the bolts when the bolts are rotated.

The present invention has arisen to mitigate and/or obviate the afore-described disadvantages of the conventional workbenches.

SUMMARY OF THE INVENTION

The primary objective of the present invention is to provide a workbench including a platform that may be quickly released and quickly positioned.

In accordance with one aspect of the invention, there is provided a workbench comprising a base including a pair of beams provided on top, the beams each including a plurality of holes formed therein, a pair of frames slidably engaged on the beams, a first platform secured on the beams, a slidable platform secured on the frames and moved in concert with the frames for allowing the slidable platform to be moved along the beams, and a positioning device secured on the frame for engaging with the holes of the beams and for securing the frame and the slidable platform to the beams. The slidable platform may be easily and quickly moved along the beams when the positioning device is disengaged from the beams.

The beams each includes an upper portion having one or more flanges, the holes are formed in the flanges for engaging with the positioning device.

The frames each includes a pair of downward dependent panels for engaging with the beam and for stably guiding the frames to move along the beams.

The frames each includes a pad secured on top, the slidable platform is secured on the pads. The pad and the frame are solidly secured together.

The positioning device includes a barrel secured to the frame, and a latch slidably engaged in the barrel, and a spring engaged in the barrel and engaged with the latch for biasing the latch to engage with the holes and for positioning the frame to the beam. The latch includes an upper end extended upward through the barrel, and includes a knob secured to the upper end of the latch for moving the latch against the spring and for disengaging the latch from the holes of the beams against the spring.

The positioning device includes a spring-biased catch pivotally coupled to the frame at a pivot shaft for allowing the catch to be biased to engage with the holes and for positioning the frame to the beam. The catch may also be disengaged from the holes of the beams when the catch is depressed against a spring biasing member.

A spring is further engaged between the frame and the beam for applying a spring force to the frame relative to the beam and for moving the frame relative to the beam in one direction.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
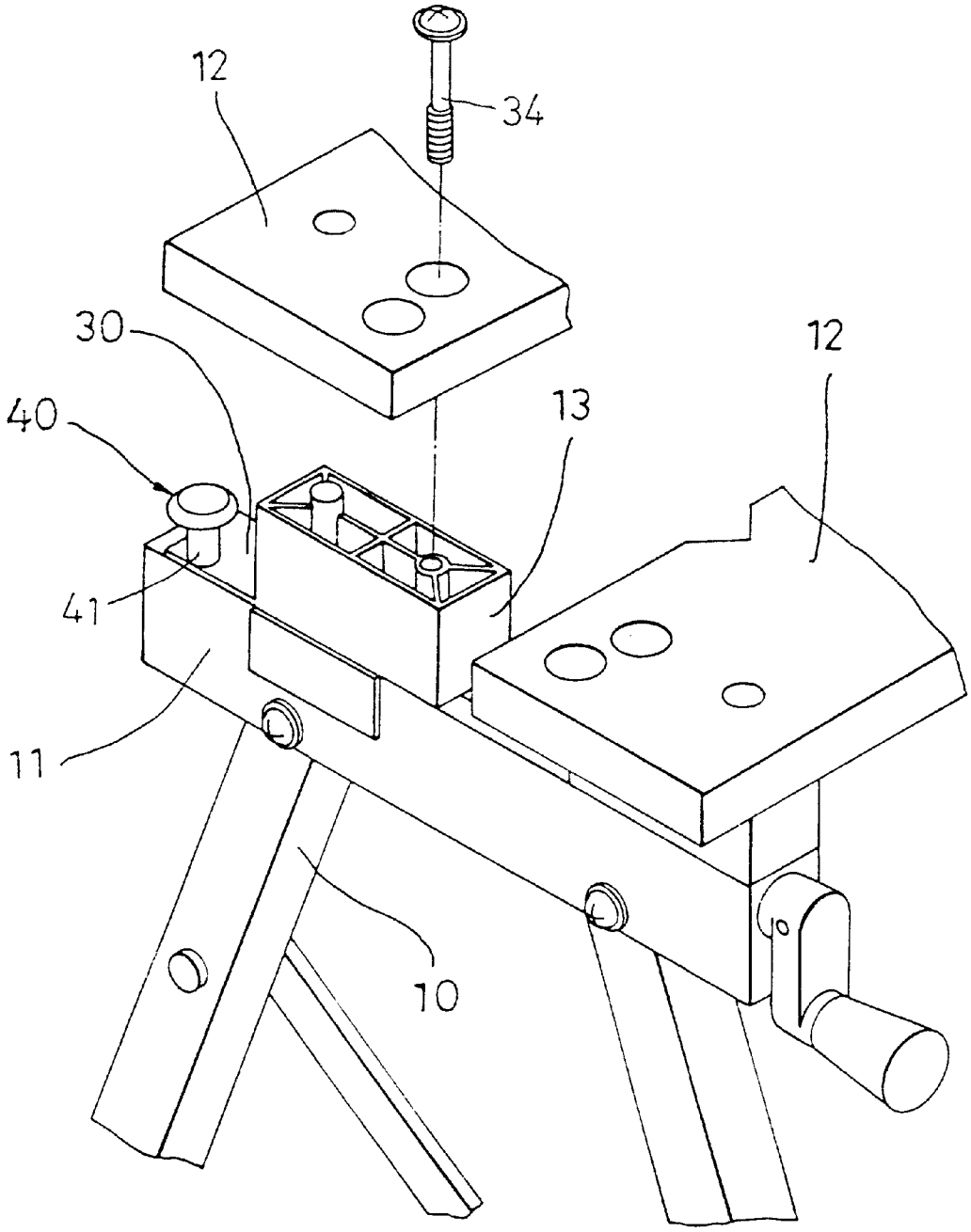
FIGS. 1 and 2 are partial exploded views of a workbench in accordance with the present invention.
Figure 2:
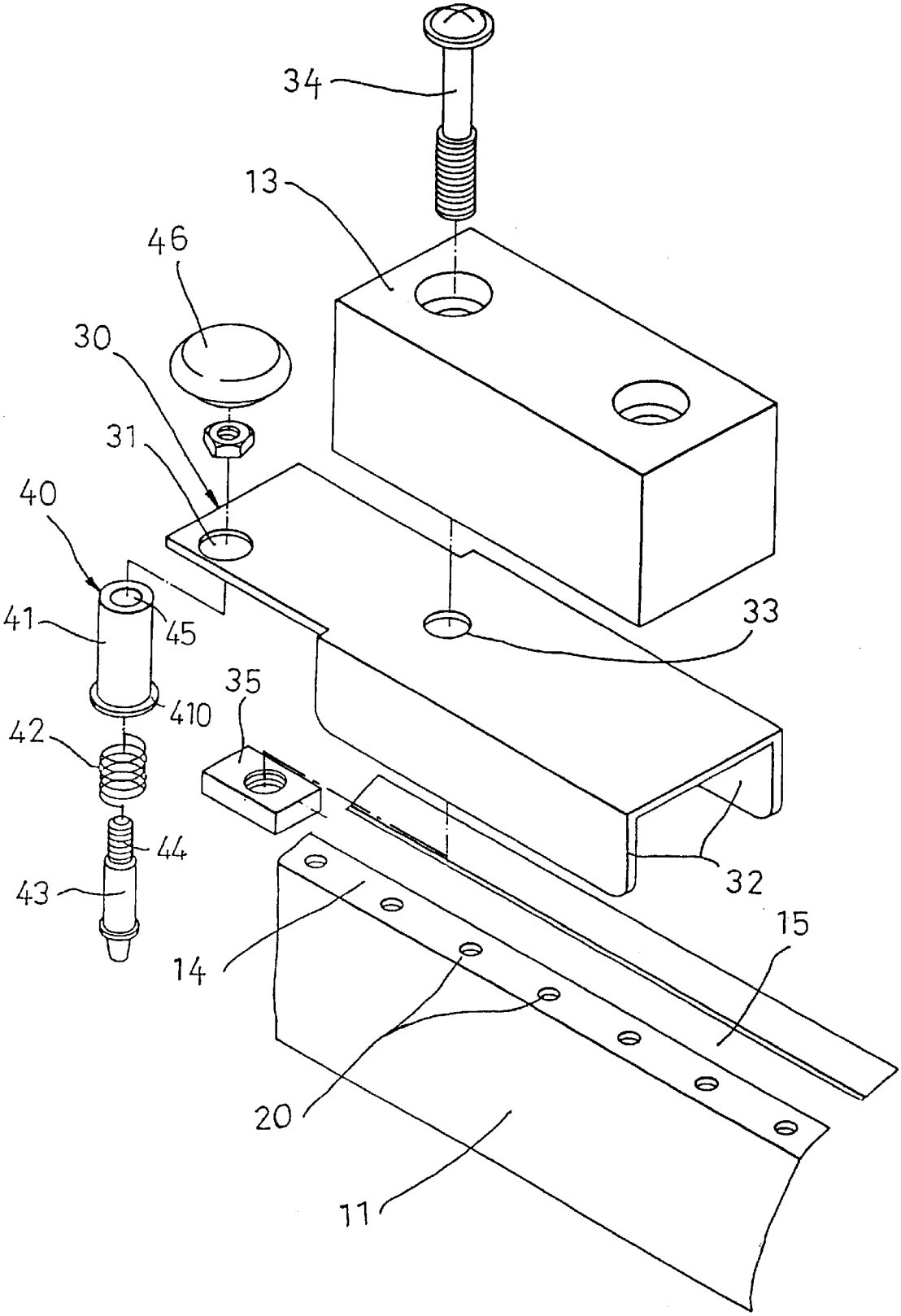

Referring to the drawings, and initially to FIGS. 1 and 2, a workbench in accordance with the present invention comprises a base 10 including a pair of beams 11 provided on top and parallel to each other, and a pair of platforms 12 secured on top of the beams 11. One of the platforms 12 is movable toward and away from the other platform 12 by a known screw mechanism. The beams 11 each includes a channel 15 formed therein for rotatably receiving a bolt. The basic structure of the workbench is shown in the cited U.S. Pat. No. 4,909,491 to Cheng and is taken as a reference for the present invention. The beams 11 each includes one or two flanges 14 extended inward of the channel 15. The flanges 14 each includes a number of holes 20 formed therein.

Two frames 30 are slidably engaged on the beams 11 respectively, however, only one of the frames 30 and only one of the beams 11 are shown in FIGS. 1 and 2. Two pads 13 are secured on the frames 30 respectively for supporting the slidable platform 12. The frames 30 each includes a pair of downward dependent panels 32 for engaging the beams 11 and for stably guiding the frames 30 to move along the beams 11 respectively. The frame 30 includes one or more holes 33 for receiving fasteners 34 which may engage with nuts 35 and may secure the slidable platform 12 and the pads 13 to the frames 30. The frame 30 includes an opening 31 for aligning with the holes 20 of the beam 11.

A positioning device 40 includes a barrel 41 engaged in the opening 31. The barrel 41 includes a bottom annular flange 410 extended radially outward for being clamped between the beam 11 and the frame 30 and for preventing the barrel 41 from being disengaged from the frame 30. The barrel 41 may further be solidly secured to the frame 30 by adhesive materials or by welding processes. The barrel 41 includes an orifice 45 formed in the upper portion. A latch 43 is slidably engaged in the barrel 41 and includes an upper portion 44 extended upward through the orifice 45 of the barrel 41 and having an outer thread for threadedly engaging with a knob 46 and for securing to the knob 46. A spring 42 is engaged between the barrel 41 and the latch 43 for biasing the latch 43 to engage with one of the holes 20 and for positioning the frame 30 to the beam 11. The latch 43 may be disengaged from the holes 20 by pulling the knob 46 against the spring 42, such that the frames 30 and thus the platform 12 may be easily and quickly moved along the beams 11 until the latch 43 is biased to engage with another hole 20 when the knob 46 is released.

Figure 3:
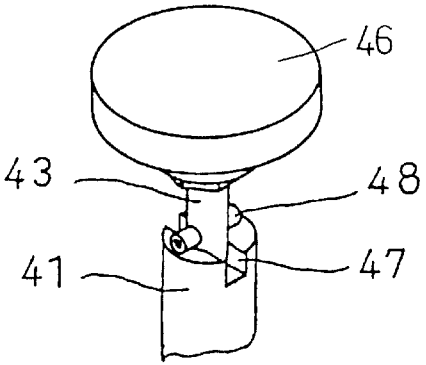
FIGS. 3 and 4 are partial perspective views showing the other application of the positioning device.
Figure 4:
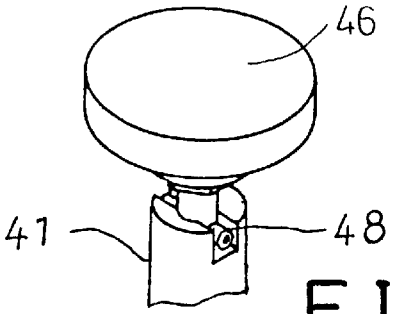

Referring next to FIGS. 3 and 4, the upper portion of the barrel 41 includes a groove 47. The latch 43 includes a pin 48 that may be biased to engage with the groove 47. When the latch 43 is pulled upward against the spring and rotated for 90 degrees, the pin 48 may be engaged on top of the barrel 41 such that the latch 43 may be maintained at the disengagement position from the holes 20 and such that the frames 30 may be moved along the beam 11 at this moment. However, as shown in FIG. 4, when the knob 46 is rotated for about 90 degrees, the pin 48 may be biased to engage inward of the groove 47 such that the latch 43 may again be biased to engage with one of the holes 20 and to secure the frame 30 to the beam 11.

Figure 5:
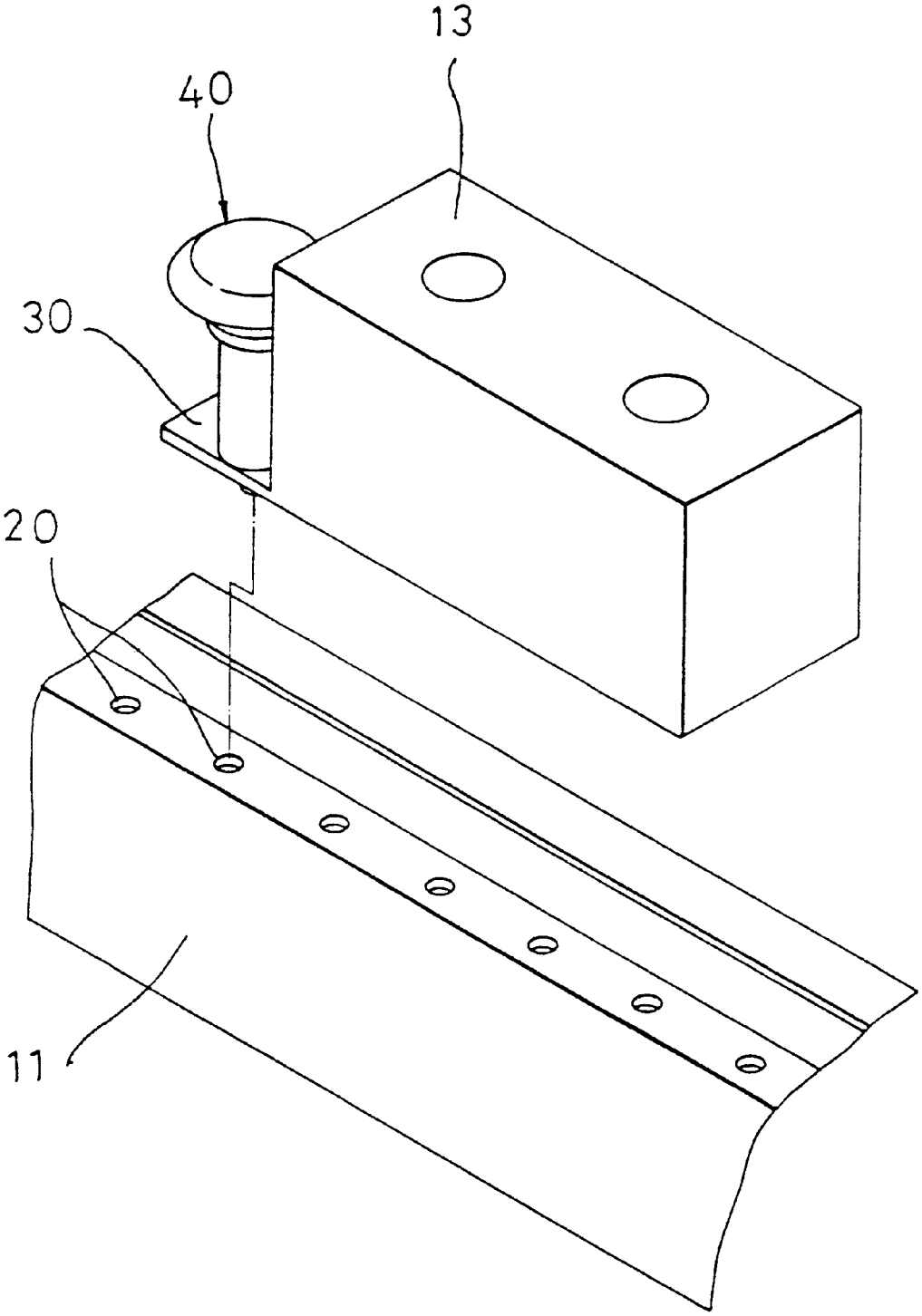
FIG. 5 is a partial exploded view showing a further application of the workbench.

Referring next to FIG. 5, the frame 30 and the pad 13 may be formed as an integral member.

Figure 7:
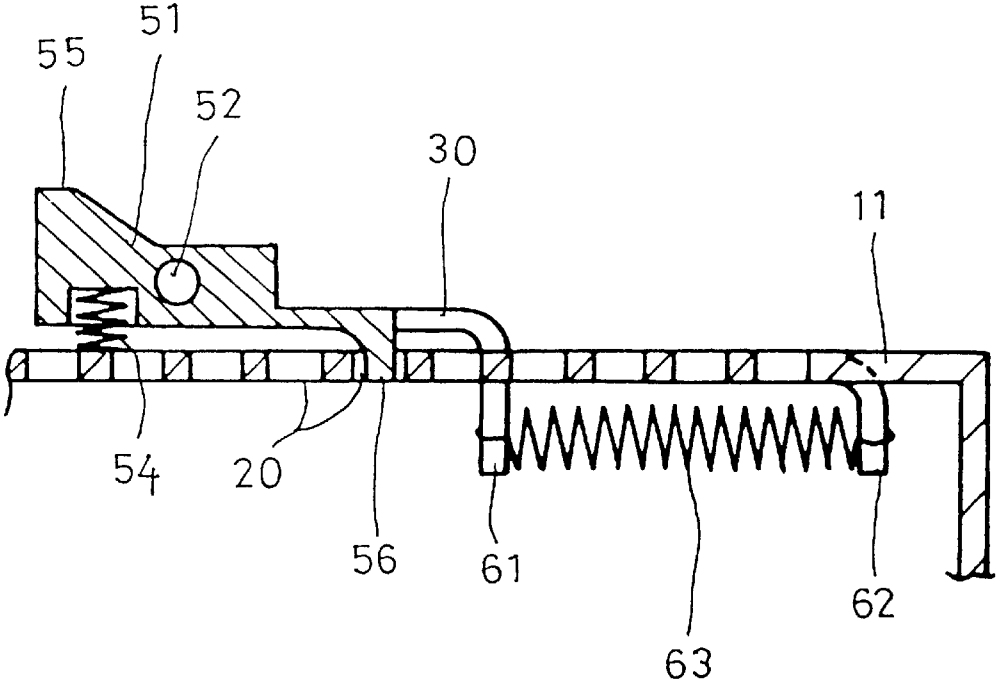
FIG. 7 is a cross sectional view illustrating the operation of the positioning device as shown in FIG. 6.
Figure 6:
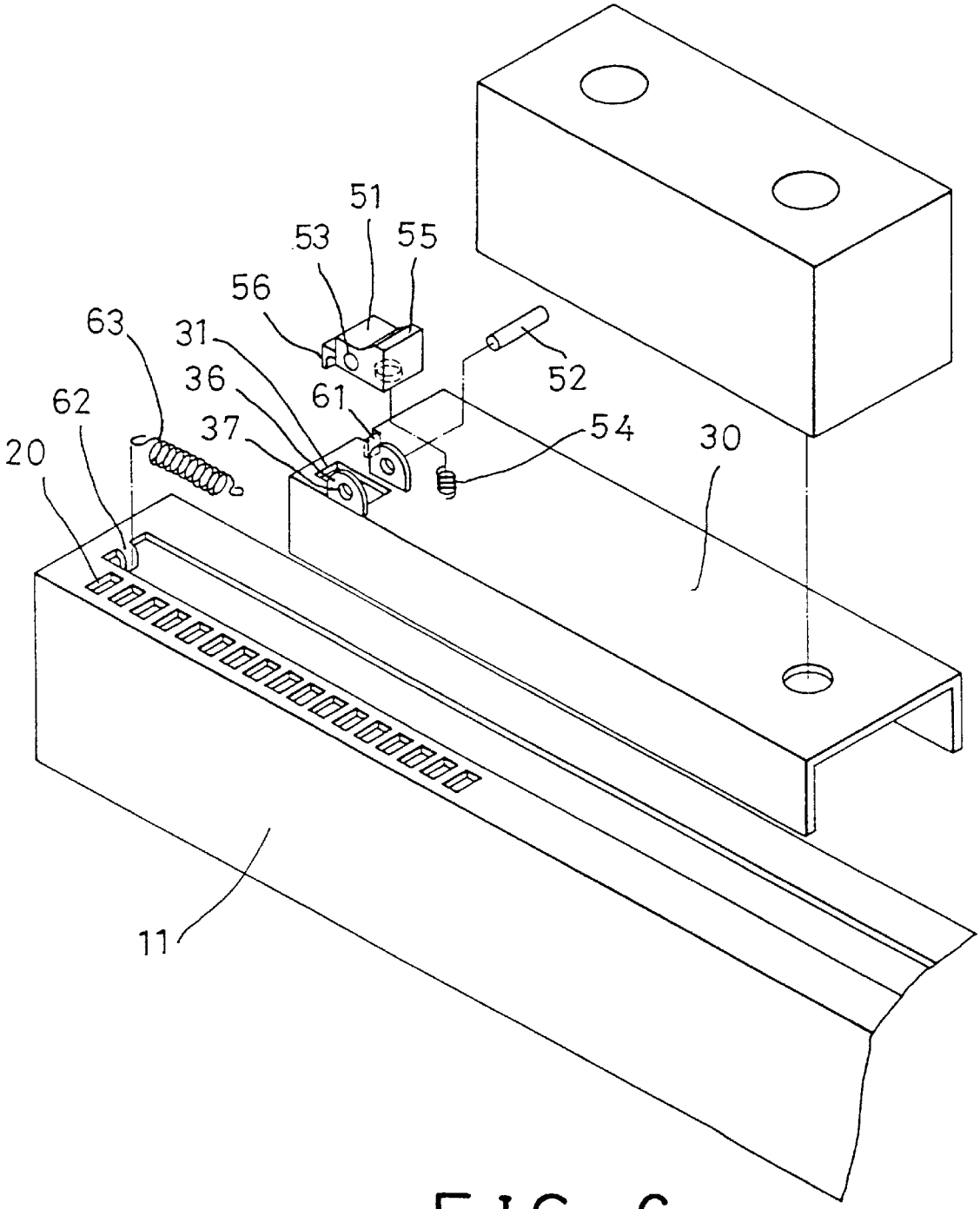
FIG. 6 is a partial exploded view showing a still further application of the workbench.

Referring next to FIGS. 6 and 7, alternatively, the frame 30 includes a pair of ears 36 extended upward therefrom and disposed beside the opening 31. A catch 51 is pivotally secured between the ears 36 at a pivot shaft 52 which is engaged through a lateral hole 53 of the catch 51 and engaged through the holes 37 of the ears 36. The catch 51 includes a hook 56 provided on one end for engaging with the holes 20 of the beam 11 and for positioning the frame 30 to the beam 11. A spring 54 is engaged with the other end of the catch 51 and engaged between the frame 30 and the catch 51 for biasing the hook 56 of the catch 51 to engage with the holes 20. The catch 51 includes a knob 55 for allowing the user to depress the catch 51 against the spring 54 and to disengage the hook 56 from the holes 20. A spring 63 may be secured between the ears 61, 62 of the frame 30 and the beam 11 for applying a spring force to the frame relative to the beam and for moving the frame 30 along the beam 11 in one direction.

Accordingly, the workbench in accordance with the present invention includes a platform that may be quickly released and quickly positioned.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A workbench comprising:

a base including a pair of beams provided on top, said beams each including a plurality of spaced apart holes formed therein and an upper portion having at least one flange, wherein said plurality of spaced apart holes are formed in said at least one flange;

a frame slidably engaged on each of said beams;

a first platform located on said beams, a second platform secured on said frames so as to move in concert with said frames thereby enabling said second platform and said frames to be moved along said beams; and, a releasable positioning device on at least one of said frames the releasable positioning device engaging one of said plurality of spaced apart holes in said beams to secure said frame and said slidable platform to said beams in one of a plurality of discreet, spaced apart positions.

2. The workbench according to claim 1, wherein said frames each further comprise a pair of downward dependent panels for engaging with said beam and for stably guiding said frames along said beams.

3. The workbench according to claim 1, wherein said frames each includes a pad secured on a top, wherein said slidable platform is secured to said pads.

4. The workbench according to claim 3, wherein said pad and said frame comprise an integral unit.

5. The workbench according to claim 1, wherein said releasable positioning device comprises: a barrel secured to said frame; a latch slidably located in said barrel so as to be movable between an extended position wherein the latch engages one of the plurality of spaced apart holes, and a retracted position wherein the latch is disengaged from the plurality of spaced apart holes enabling the frames to be moved along the beams; and a spring located in said barrel and acting on said latch to bias said latch toward the extended position to engage one of said plurality of spaced apart holes for positioning said frame on said beam.

6. The workbench according to claim 5, wherein said latch includes an upper end extending upwardly through said barrel, and further comprising a knob secured to said upper end of said latch for manually moving said latch against said spring to the retracted position.

7. The workbench according to claim 1, wherein said positioning device comprises: a catch pivotally mounted on said frame, the catch including a hook and being movable between a first position wherein the hook engages one of the plurality of spaced apart holes, and a second position wherein the hook is disengaged from said plurality of spaced apart holes enabling the frame to be moved along the beam; and a spring acting on the catch so as to bias the hook toward the first position for positioning said frame on said beam.

8. The workbench according to claim 7 further comprising a second spring engaged between said frame and said beam applying a biasing force to said frame urging said frame to a predetermined position relative to said beam.

9. A workbench comprising:

a base including a pair of beams provided on top, said beams each including a plurality of spaced apart holes formed therein;

a frame slidably engaged on each of said beams;

a first platform located on said beams, a second platform secured on said frames so as to move in concert with said frames thereby enabling said second platform and said frames to be moved along said beams; and, a releasable positioning device on at least one of said frames, the releasable positioning device engaging one of said plurality of spaced apart holes in said beams to secure said frame and said slidable platform to said beams in one of a plurality of discreet, spaced apart positions, said releasable positioning device comprising a barrel secured to said frame; a latch slidably located in said barrel so as to be movable between an extended position wherein the latch engages one of the plurality of spaced apart holes, and a retracted position wherein the latch is disengaged from the plurality of spaced apart holes enabling the frames to be moved along the beams; and a spring located in said barrel and acting on said latch to bias said latch toward the extended position to engage one of said plurality of spaced apart holes for positioning said frame on said beam.

10. The workbench according to claim 9, wherein said frames each further comprise a pair of downward dependent panels for engaging with said beam and for stably guiding said frames along said beams.

11. The workbench according to claim 9, wherein said frames each includes a pad secured on a top, wherein said slidable platform is secured to said pads.

12. The workbench according to claim 11, wherein said pad and said frame comprise an integral unit.

13. The workbench according to claim 9, wherein said latch includes an upper end extending upwardly through said barrel, and further comprising a knob secured to said upper end of said latch for manually moving said latch against said spring to the retracted position.

14. A workbench comprising:

a base including a pair of beams provided on top, said beams each including a plurality of spaced apart holes formed therein;

a frame slidably engaged on each of said beams;

a first platform located on said beams, a second platform secured on said frames so as to move in concert with said frames thereby enabling said second platform and said frames to be moved along said beams; and, a releasable positioning device on at least one of said frames the releasable positioning device engaging one of said plurality of spaced apart holes in said beams to secure said frame and said slidable platform to said beams in one of a plurality of discreet, spaced apart positions, said releasable positioning device comprising a catch pivotally mounted on said frame, the catch including a hook and being movable between a first position wherein the hook engages one of the plurality of spaced apart holes, and a second position wherein the hook is disengaged from said plurality of spaced apart holes enabling the frame to be moved along the beam; and a spring acting on the catch so as to bias the hook toward the first position for positioning said frame on said beam.

15. The workbench according to claim 14, wherein said frames each further comprise a pair of downward dependent panels for engaging with said beam and for stably guiding said frames along said beams.

16. The workbench according to claim 14, wherein said frames each includes a pad secured on a top, wherein said slidable platform is secured to said pads.

17. The workbench according to claim 16, wherein said pad and said frame comprise an integral unit.

18. The workbench according to claim 14 further comprising a second spring engaged between said frame and said beam applying a biasing force to said frame urging said frame to a predetermined position relative to said beam.

* * * * *